US007696145B2

(12) United States Patent
Kaaret

(10) Patent No.: US 7,696,145 B2
(45) **Date of Patent: *Apr. 13, 2010**

(54) NATURAL CLEANING COMPOSITIONS

(75) Inventor: Thomas W. Kaaret, Alamo, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/350,411

(22) Filed: Jan. 8, 2009

(65) Prior Publication Data

US 2009/0111724 A1 Apr. 30, 2009

Related U.S. Application Data

(63) Continuation-in-part of application No. 12/142,969, filed on Jun. 20, 2008, now Pat. No. 7,527,060, which is a continuation-in-part of application No. 11/765,516, filed on Jun. 20, 2007, now Pat. No. 7,396,808.

(51) Int. Cl.
*C11D 3/22* (2006.01)
*C11D 3/44* (2006.01)
*C11D 7/50* (2006.01)

(52) U.S. Cl. ..... 510/474; 510/191; 510/197; 510/199; 510/235; 510/238; 510/240; 510/246; 510/253; 510/271; 510/470; 510/505

(58) Field of Classification Search ..... 510/191, 510/197, 199, 235, 238, 240, 246, 253, 271, 510/470, 474, 505
See application file for complete search history.

(56) References Cited

U.S. PATENT DOCUMENTS

| | | | | |
|---|---|---|---|---|
| 4,753,844 | A | 6/1988 | Jones et al. | |
| 5,025,069 | A | 6/1991 | Deguchi et al. | |
| 5,342,534 | A | 8/1994 | Skrobala et al. | |
| 6,121,228 | A | 9/2000 | Draper et al. | |
| 6,302,969 | B2 | 10/2001 | Moster et al. | |
| 6,336,977 | B1 * | 1/2002 | Menke et al. | 134/42 |
| 6,420,326 | B1 | 7/2002 | Maile et al. | |
| 6,831,050 | B2 | 12/2004 | Murch et al. | |
| 7,082,951 | B2 | 8/2006 | Barnabas et al. | |
| 7,182,950 | B2 | 2/2007 | Garti et al. | |
| 7,396,808 | B1 | 7/2008 | Hood | |
| 7,465,700 | B1 | 12/2008 | Ochomogo | |
| 7,511,006 | B2 * | 3/2009 | Shimmin et al. | 510/295 |
| 7,521,413 | B2 | 4/2009 | Ochomogo | |
| 7,527,060 | B2 | 5/2009 | Hood | |
| 7,629,305 | B1 | 12/2009 | Szekeres | |
| 7,637,271 | B1 | 12/2009 | Cumberland | |
| 2004/0031107 | A1 | 2/2004 | Pegelow | |
| 2005/0113277 | A1 | 5/2005 | Sherry | |
| 2005/0153857 | A1 | 7/2005 | Sherry | |
| 2005/0239674 | A1 | 10/2005 | Dreja | |
| 2005/0282720 | A1 | 12/2005 | Itoh et al. | |
| 2007/0094827 | A1 | 5/2007 | Kilkenny et al. | |
| 2007/0099816 | A1 | 5/2007 | Scheuing et al. | |
| 2008/0255023 | A1 * | 10/2008 | Shimmin et al. | 510/470 |

FOREIGN PATENT DOCUMENTS

| | | |
|---|---|---|
| WO | WO99/60085 | 11/1999 |
| WO | WO2005/091981 | 10/2005 |

OTHER PUBLICATIONS

U.S. Appl. No. 12/397,164, filed Mar. 9, 2008, Shimmin.

* cited by examiner

*Primary Examiner*—Brian P Mruk
(74) *Attorney, Agent, or Firm*—Alok Goel

(57) ABSTRACT

A cleaning composition with a limited number of natural ingredients contains alkyl polyglucoside, solvent, acetic acid and water. The cleaning composition optionally contains dyes, glycerol, builders, fatty acids, polymers, fragrances, colorants, anti-foaming agents and preservatives. The cleaning composition can be used to clean hard surfaces and cleans as well or better than commercial compositions containing synthetically derived cleaning agents.

20 Claims, No Drawings

NATURAL CLEANING COMPOSITIONS

CROSS-REFERENCES TO RELATED APPLICATIONS

This application is a continuation-in-part of application of U.S. Ser. No. 12/142,969, filed on Jun. 20, 2008 and now U.S. Pat. No. 7,527,060, which is a continuation-in-part of U.S. Ser. No. 11/765,516, filed on Jun. 20, 2007, and now U.S. Pat. No. 7,396,808, which are incorporated herein by reference.

BACKGROUND OF THE INVENTION

1. Field of the Invention

The present invention relates generally to cleaning compositions and methods for use on hard surfaces (i.e. glass). The invention also relates to cleaning compositions for use with cleaning substrates, cleaning heads, cleaning pads, cleaning sponges and related systems for cleaning hard surfaces. The composition also relates to natural cleaning compositions having a limited number of ingredients and having good cleaning properties and low residue.

2. Description of the Related Art

Cleaning formulations have progressed and created a large chemical industry devoted to developing new synthetic surfactants and solvents to achieve ever improving cleaning compositions for the consumer. Recently, consumers have shown increasing interest in natural and sustainable products. Obstacles in selling such products include the expense to the consumer, since many conventional cleaners typically cost half as much as natural products or products based on sustainable materials. Another inconvenience to consumers of such products includes the limited distribution of natural products, which are often found only in speciality stores. Finally, there remains a significant gap in the performance of natural products, relative to that of highly developed formulations based on synthetic surfactants and solvents which are produced from petrochemical feedstocks. Companies marketing natural or sustainable consumer products have had difficulty in formulating cleaners that deliver acceptable consumer performance, while utilizing only a limited number of natural and/or sustainably produced components.

Typical cleaning formulations require multiple surfactants, solvents, and builder combinations to achieve adequate consumer performance. For example, U.S. Pat. No. 5,025,069 to Deguchi et al. discloses alkyl glycoside detergent systems with anionic, amphoteric and nonionic surfactant ingredients. U.S. Pat. No. 7,182,950 to Garti et al. discloses nano-sized concentrates with examples using Tween® surfactants. U.S. Pat. No. 6,831,050 to Murch et al. discloses toxicologically acceptable cleaners containing oleic acid and citric acid. U.S. Pat. No. 6,302,969 to Moster et al. discloses natural cleaners containing anionic surfactants. U.S. Pat. No. 6,420,326 to Maile et al. discloses glass cleaners with ethanol, glycol ethers, and anionic surfactants.

Prior art compositions do not combine effective cleaning with a minimum number of ingredients, especially with natural ingredients. It is therefore an object of the present invention to provide a cleaning composition that overcomes the disadvantages and shortcomings associated with prior art cleaning compositions.

SUMMARY OF THE INVENTION

In accordance with the above objects and those that will be mentioned and will become apparent below, one aspect of the present invention comprises a hard surface cleaning composition consisting essentially of: a. 0.01 to 5 weight % alkyl polyglucoside; b. 0.5 to 5.0 weight % of a solvent selected from the group consisting of ethanol, isopropanol, sorbitol, glycerol, propylene glycol, 1,3-propanediol and mixtures thereof, c. 0.05 to 3.0 weight % of acetic acid; d. water; and e. optionally dyes, builders, fatty acids, polymers, fragrances, water, colorants, anti-foaming agent and preservatives.

In accordance with the above objects and those that will be mentioned and will become apparent below, another aspect of the present invention comprises a hard surface cleaning composition consisting essentially of: a. 0.01 to 5% alkyl polyglucoside of a $C_8$ to $C_{10}$ alkylpolyglucoside wherein the alkyl group is substantially $C_8$ alkyl, substantially $C_{10}$ alkyl, or a mixture of substantially $C_8$ and $C_{10}$ alkyl; b. 0.01 to 5.0% alkyl polyglucoside of a $C_8$ to $C_{16}$ alkylpolyglucoside; c. 0.5 to 5.0 weight % of solvent selected from the group consisting of ethanol, isopropanol and mixtures thereof, d. 0.05 to 3.0 weight % of acetic acid; e. water; and f. optionally dyes, glycerol, builders, fatty acids, polymers, fragrances, water, colorants, anti-foaming agent and preservatives.

In accordance with the above objects and those that will be mentioned and will become apparent below, another aspect of the present invention comprises a hard surface cleaning composition comprising a. 0.01 to 5.0 weight % alkyl polyglucoside; b. 0.5 to 5.0 weight % of a solvent selected from the group consisting of ethanol, isopropanol, sorbitol, glycerol, propylene glycol, 1,3-propanediol and mixtures thereof, c. 0.05 to 3.0 weight % of acetic acid; d. water; and e. optionally dyes, builders, fatty acids, polymers, fragrances, colorants, anti-foaming agent and preservatives, wherein said composition contains no additional surfactant and no additional organic solvent.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

The term "consisting essentially of" as used herein, limits the scope of a claim to the specified materials or steps "and those that do not materially affect the basic and novel characteristic(s)" of the claimed invention. In re Herz, 537 F.2d 549, 551-52, 190 USPQ 461, 463 (CCPA 1976) (emphasis in original). See MPEP 2111.03 For the purposes of searching for and applying prior art under 35 U.S.C. 102 and 103, absent a clear indication in the specification or claims of what the basic and novel characteristics actually are, "consisting essentially of" will be construed as equivalent to "comprising." See, e.g., PPG, 156 F.3d at 1355, 48 USPQ2d at 1355. See MPEP 2111.03

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, zwiterrionic and/or amphoteric agents.

The term "natural" as used herein is meant to mean at least 95% of the components of the product are derived from plant and mineral based materials. Also, the "natural" product is biodegradable. Additionally, the "natural" product is minimally toxic to humans and has a LD50>5000 mg/kg. The "natural" product does not contain of any of the following: non-plant based ethoxylated surfactants, linear alkylbenzene sulfonates ("LAS"), ether sulfates surfactants or nonylphenol ethoxylate (NPE).

The term "ecofriendly" as used herein is meant to mean at least 99% of the components of the product are derived from plant and mineral based materials. Also, the "ecofriendly" product is biodegradable. Additionally, the "ecofriendly" product is minimally toxic to humans and has a LD50>5000 mg/kg. The "ecofriendly" product does not contain of any of the following: non-plant based ethoxylated surfactants, linear alkylbenzene sulfonates ("LAS"), ether sulfates surfactants or nonylphenol ethoxylate (NPE).

The term "biodegradable" as used herein is meant to mean microbial degradation of carbon containing materials. The "biodegradable" material must be tested under a recognized protocol and with tested methods of established regulatory bodies such as: EPA, EPA-TSCA, OECD, MITI or other similar or equivalent organizations in the US or internationally. Suitable non-limiting examples of test methods for biodegradation include: OECD methods in the 301-305 series. Generally, all "biodegradable" material must meet the following limitations:

a) removal of dissolved organic carbon>70% b) biological oxygen demand (BOD)>60% c) % of BOD of theoretical oxygen demand>60% d) % CO2 evolution of theoretical>60%

Alkyl Polyglucoside

The cleaning compositions contain alkyl polyglucoside surfactant. The cleaning compositions preferably have an absence of other nonionic surfactants, expecially synthetic nonionic surfactants, such as ethoxylates. The cleaning compositions preferably have an absence of other surfactants, such as anionic, cationic, and amphoteric surfactants. In some embodiments of the present invention, there are no additional surfactants in the present invention other than alkyl polyglucoside. Suitable alkyl polyglucoside surfactants are the alkylpolysaccharides that are disclosed in U.S. Pat. No. 5,776,872 to Giret et al.; U.S. Pat. No. 5,883,059 to Furman et al; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g., a polyglycoside, hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkylpolyglycosides (or alkylpolyglucosides) have the formula: $R^2O(C_nH_{2n}O)_t(\text{glucosyl})_x$ wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is about 2 or about 3, preferably about 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantely the 2-position.

A group of alkyl glycoside surfactants suitable for use in the practice of this invention may be represented by Formula I below:

$$RO—(R^2O)_y\text{-}(G)_xZ_b \qquad \text{Formula I}$$

wherein R is a monovalent organic radical containing from about 6 to about 30 (preferably from about 8 to about 18) carbon atoms; $R^2$ is a divalent hydrocarbon radical containing from about 2 to about 4 carbon atoms; O is an oxygen atom; y is a number which has an average value from about 0 to about 1 and is preferably 0; G is a moiety derived from a reducing saccharide containing 5 or 6 carbon atoms; and x is a number having an average value from about 1 to 5 (preferably from 1.1 to 2); Z is $O_2M^1$, $O_2CR^3$, $O(CH_2)$, $CO_2M^1$, $OSO_3M^1$, or $O(CH_2)SO_3M^1$; $R^3$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $—CO_2M^1$ group); b is a number from 0 to 3x+1 preferably an average of from 0.5 to 2 per glycosal group; p is 1 to 10, $M^1$ is $H^+$ or an organic or inorganic cation, such as, for example, an alkali metal, ammonium, monoethanolamine, or calcium. As defined in Formula I, R is generally the residue of a fatty alcohol having from about 8 to 30 or 8 to 18 carbon atoms. Suitable alkylglycosides include, for example, APG 325® (a $C_9$-$C_{11}$ alkyl polyglycoside available from Cognis Corporation), APG 625® (a $C_{10}$-$C_{16}$ alkyl polyglycoside available from Cognis Corporation), Glucopon® 425N (a $C_8$ to $C_{16}$ alkyl polyglucoside), Glucopon® 215 CS UP (a $C_8$ to $C_{10}$ alkyl polyglucoside), (Dow Triton® CG110 (a $C_8$-$C_{10}$ alkyl polyglycoside available from Dow Chemical Company), AG6202® (a $C_8$ alkyl polyglycoside available from Akzo Nobel) and Alkadet 15® (a $C_8$-$C_{10}$ alkyl polyglycoside available from Huntsman Corporation). A $C_6$ to $C_{10}$ alkylpolyglucoside includes alkylpolyglucosides wherein the alkyl group is substantially $C_6$ alkyl, substantially $C_8$ alkyl, substantially $C_{10}$ alkyl, or a mixture of substantially $C_6$, $C_8$ and $C_{10}$ alkyl. A $C_8$ to $C_{10}$ alkylpolyglucoside includes alkylpolyglucosides wherein the alkyl group is substantially $C_8$ alkyl, substantially $C_{10}$ alkyl, or a mixture of substantially $C_8$ and $C_{10}$ alkyl. Suitably, the alkyl polyglycoside is present in the cleaning composition in an amount ranging from about 0.01 to about 5.0 weight percent, or from about 0.01 to about 4.0 weight percent, or from about 0.01 to about 3.0 weight percent, or from about 0.01 to about 2.0 weight percent, or from about 0.01 to about 1.5 weight percent, or from about 0.01 to about 1.0 weight percent.

Solvents

The cleaning compositions can contain limited amounts of organic solvents, such as ethanol, isoproanol, sorbitol, glycerol, propylene glycol, 1,3-propanediol, and mixtures thereof. The compositions preferably contain solvents from natural sources rather than solvents from synthetic petrochemical sources, such as glycol ethers, hydrocarbons, and polyalkylene glycols. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. Methanol and propylene glycol may be incidental components in the cleaning compositions. In some embodiments of the present invention, the present invention works only with the following solvents: ethanol, isoproanol, sorbitol, glycerol, propylene glycol, 1,3-propanediol, and mixtures thereof (i.e. no additional organic solvents).

The compositions should be free of other organic solvents (or only trace amounts of less than 0.5% or 0.1%) other than the ones already enumerated above including. The compositions should be free of the following alkanols: n-propanol, isopropanol, butanol, pentanol, and hexanol, and isomers thereof. The compositions should be free of the following diols: methylene glycol, ethylene glycol, and butylene glycols. The compositions should be free of the following alkylene glycol ethers which include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. The compositions should be free of the following short chain esters which include, but are not limited to, glycol acetate, and cyclic or linear volatile methylsiloxanes. The composition should not contain any alkyl glycol ethers, alcohol alkoxylates, alkyl monoglycerolether sulfate, or alkyl ether sulfates.

Suitably, the solvent is present in the cleaning composition in an amount ranging from about 0.01 to about 10 weight percent, or from about 0.1 to about 5.0 weight percent, or from about 0.1 to about 4.0 weight percent, or from about 0.1 to about 3.0 weight percent, or from about 0.1 to about 2.0 weight percent, or from about 0.1 to about 1.0 weight percent, or from about 0.5 to about 5.0 weight percent, or from about 0.5 to about 4.0 weight percent, or from about 0.5 to about 3.0 weight percent, or from about 0.5 to about 2.0 weight percent, or from about 0.5 to about 1.0 weight percent.

Acetic Acid

The cleaning compositions can contain acetic acid. Acetic acid is one of the simplest carboxylic acids in chemistry. Acetic acid is considered a weak acid because at standard conditions for temperature and pressure the dissociated acid exists in equilibrium with the undissociated form in aqueous solutions, in contrast to strong acids, which are fully dissociated. In the form of vinegar, acetic acid solutions (typically 5 to 30% of acetic acid) are used in hard surface cleaners. Diluted acetic acid is typically used in hard surface cleaners for their mild acidity.

Suitably, the acetic acid is present in the cleaning composition in an amount ranging from about 0.01 to about 5.0 weight percent, or from about 0.01 to about 4.0 weight percent, or from about 0.01 to about 3.0 weight percent, or from about 0.01 to about 2.0 weight percent, or from about 0.01 to about 1.0 weight percent, or from about 0.01 to 0.5 weight percent, or from about 0.01 to about 0.1 weight percent.

Lemon Oil D-Limonene and Other Essential Oils

The cleaning compositions can optionally contain natural essential oils or fragrances containing d-limonene or lemon oil or d-limonene. Lemon oil or d-limonene helps the performance characteristics of the cleaning composition to allow suitable consumer performance with natural ingredients and a minimum of ingredients. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, lemon oil, d-limonene, or essential oils containing d-limonene are present in the cleaning composition in an amount ranging from about 0.01 to about 0.50 weight percent, or from about 0.01 to about 0.40 weight percent, or from about 0.01 to about 0.30 weight percent, or from about 0.01 to about 0.25 weight percent, or from about 0.01 to about 0.20 weight percent, or from about 0.01 to about 0.10 weight percent, or from about 0.05 to about 0.40 weight percent, or from about 0.05 to about 0.30 weight percent, or from about 0.05 to about 0.25 weight percent, or from about 0.05 to about 0.20 weight percent, or from about 0.05 to about 0.10 weight percent.

Essential oils include, but are not limited to, those obtained from thyme, lemongrass, citrus, lemons, oranges, anise, clove, aniseed, pine, cinnamon, geranium, roses, mint, lavender, citronella, eucalyptus, peppermint, camphor, sandalwood, rosmarin, vervain, fleagrass, lemongrass, ratanhiae, cedar and mixtures thereof. Preferred essential oils to be used herein are thyme oil, clove oil, cinnamon oil, geranium oil, eucalyptus oil, peppermint oil, mint oil or mixtures thereof.

Actives of essential oils to be used herein include, but are not limited to, thymol (present for example in thyme), eugenol (present for example in cinnamon and clove), menthol (present for example in mint), geraniol (present for example in geranium and rose), verbenone (present for example in vervain), eucalyptol and pinocarvone (present in eucalyptus), cedrol (present for example in cedar), anethol (present for example in anise), carvacrol, hinokitiol, berberine, ferulic acid, cinnamic acid, methyl salycilic acid, methyl salycilate, terpineol and mixtures thereof. Preferred actives of essential oils to be used herein are thymol, eugenol, verbenone, eucalyptol, terpineol, cinnamic acid, methyl salycilic acid, and/or geraniol.

Other essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen. Each of these botanical oils is commercially available.

Builders

The cleaning compositions contain less than 0.5% builder, or no builder. Suitably, the builder is present in the cleaning composition in an amount ranging from about 0.01 to about 0.5 weight percent, or 0.01 to less than 0.5 weight percent, or 0.01 to 0.25 weight percent, or 0.01 to 0.10 weight percent, or 0.01 to 0.05 weight percent. The builder can be selected from inorganic builders, such as alkali metal carbonate, alkali metal bicarbonate, alkali metal hydroxide, alkali metal silicate and combinations thereof. These builders are often obtained from natural sources.

The cleaning composition can include a builder, which increases the effectiveness of the surfactant. The builder can also function as a softener, a sequestering agent, a buffering agent, or a pH adjusting agent in the cleaning composition. A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxy-sulfonates, and starch derivatives. Builders, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2-methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl)amino methane (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other preferred pH adjusting agents include sodium or potassium hydroxide. The term silicate is meant to encompass silicate, metasilicate, polysilicate, aluminosilicate and similar compounds.

pH

The pH of the cleaning composition is measured directly without dilution. The cleaning compositions can have a pH or 7 or below, or 6.5 or below, or 6 or below, or 5 or below, or 4 or below, or from about 1.0 to about 6.0, or from about 2.0 to about 5.0, or from about 2.5 to about 4.5, or from about 3.0 to about 4.0.

Adjuncts

The cleaning compositions optionally contain dyes, fatty acids, polymers, anti-foaming agents, colorants and preservatives, or contain one or more adjuncts, or none of these components. These components can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1, 3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene.

Substances Generally Recognized As Safe

Compositions according to the invention may comprise substances generally recognized as safe (GRAS), including essential oils, oleoresins (solvent-free) and natural extractives (including distillates), and synthetic flavoring materials and adjuvants. Compositions may also comprise GRAS materials commonly found in cotton, cotton textiles, paper and paperboard stock dry food packaging materials (referred herein as substrates) that have been found to migrate to dry food and, by inference may migrate into the inventive compositions when these packaging materials are used as substrates for the inventive compositions.

Suitable GRAS materials are listed in the Code of Federal Regulations (CFR) Title 21 of the United States Food and Drug Administration, Department of Health and Human Services, Parts 180.20, 180.40 and 180.50, which are hereby incorporated by reference. These suitable GRAS materials include essential oils, oleoresins (solvent-free), and natural extractives (including distillates). The GRAS materials may be present in the compositions in amounts of up to about 10% by weight, preferably in amounts of 0.01 and 5% by weight.

Preferred GRAS materials include oils and oleoresins (solvent-free) and natural extractives (including distillates) derived from alfalfa, allspice, almond bitter (free from prussic acid), ambergris, ambrette seed, angelica, angostura (cusparia bark), anise, apricot kernel (persic oil), asafetida, balm (lemon balm), balsam (of Peru), basil, bay leave, bay (myrcia oil), bergamot (bergamot orange), bois de rose (Aniba rosaeodora Ducke), cacao, camomile (chamomile) flowers, cananga, capsicum, caraway, cardamom seed (cardamon), carob bean, carrot, cascarilla bark, *cassia* bark, Castoreum, celery seed, cheery (wild bark), chervil, cinnamon bark, Civet (zibeth, zibet, zibetum), ceylon (*Cinnamomum zeylanicum* Nees), cinnamon (bark and leaf), citronella, citrus peels, clary (clary sage), clover, coca (decocainized), coffee, cognac oil (white and green), cola nut (kola nut), coriander, cumin (cummin), curacao orange peel, cusparia bark, dandelion, dog grass (quackgrass, triticum), elder flowers, estragole (esdragol, esdragon, estragon, tarragon), fennel (sweet), fenugreek, galanga (galangal), geranium, ginger, grapefruit, guava, hickory bark, horehound (hoarhound), hops, horsemint, hyssop, immortelle (Helichrysum augustifolium DC), jasmine, juniper (berries), laurel berry and leaf, lavender, lemon, lemon grass, lemon peel, lime, linden flowers, locust bean, lupulin, mace, mandarin (Citrus reticulata Blanco), marjoram, mate, menthol (including menthyl acetate), molasses (extract), musk (Tonquin musk), mustard, naringin, neroli (bigarade), nutmeg, onion, orange (bitter, flowers, leaf, flowers, peel), origanum, palmarosa, paprika, parsley, peach kernel (persic oil, pepper (black, white), peanut (stearine), peppermint, Peruvian balsam, petitgrain lemon, petitgrain mandarin (or tangerine), pimenta, pimenta leaf, pipsissewa leaves, pomegranate, prickly ash bark, quince seed, rose (absolute, attar, buds, flowers, fruit, hip, leaf), rose geranium, rosemary, safron, sage, St. John's bread, savory, schinus molle (Schinus molle L), sloe berriers, spearmint, spike lavender, tamarind, tangerine, tarragon, tea (*Thea sinensis* L.), thyme, tuberose, turmeric, vanilla, violet (flowers, leaves), wild cherry bark, ylang-ylang and zedoary bark.

Suitable synthetic flavoring substances and adjuvants are listed in the Code of Federal Regulations (CFR) Title 21 of the United States Food and Drug Administration, Department of Health and Human Services, Part 180.60, which is hereby incorporated by reference. These GRAS materials may be present in the compositions in amounts of up to about 1% by weight, preferably in amounts of 0.01 and 0.5% by weight.

Suitable synthetic flavoring substances and adjuvants that are generally recognized as safe for their intended use, include acetaldehyde (ethanal), acetoin (acetyl methylcarbinol), anethole (parapropenyl anisole), benzaldehyde (benzoic aldehyde), n-Butyric acid (butanoic acid), d- or l-carvone (carvol), cinnamaldehyde (cinnamic aldehyde), citral (2,6-dimethyloctadien-2,6-al-8, gera-nial, neral), decanal (N-decylaldehyde, capraldehyde, capric aldehyde, caprinaldehyde, aldehyde C-10), ethyl acetate, ethyl butyrate, 3-Methyl-3-phenyl glycidic acid ethyl ester (ethyl-methyl-phenyl-glycidate, so-called strawberry aldehyde, C-16 aldehyde), ethyl vanillin, geraniol (3,7-dimethyl-2,6 and 3,6-octadien-1-ol), geranyl acetate (geraniol acetate), limonene (d-, l-, and dl-), linalool (linalol, 3,7-dimethyl-1,6-octadien-3-ol), linalyl acetate (bergamol), methyl anthranilate (methyl-2-aminobenzoate), piperonal (3,4-methylenedioxy-benzaldehyde, heliotropin) and vanillin.

Suitable GRAS substances that may be present in the inventive compositions that have been identified as possibly migrating to food from cotton, cotton textiles, paper and paperboard materials used in dry food packaging materials are listed in the Code of Federal Regulations (CFR) Title 21 of the United States Food and Drug Administration, Department of Health and Human Services, Parts 180.70 and 180.90, which are hereby incorporated by reference. The GRAS materials may be present in the compositions either by addition or incidentally owing to migration from the substrates to the compositions employed in the invention, or present owing to both mechanisms. If present, the GRAS materials may be present in the compositions in amounts of up to about 1% by weight.

Suitable GRAS materials that are suitable for use in the invention, identified as originating from either cotton or cotton textile materials used as substrates in the invention, include beef tallow, carboxymethylcellulose, coconut oil (refined), cornstarch, gelatin, lard, lard oil, oleic acid, peanut oil, potato starch, sodium acetate, sodium chloride, sodium silicate, sodium tripolyphosphate, soybean oil (hydrogenated), talc, tallow (hydrogenated), tallow flakes, tapioca starch, tetrasodium pyrophosphate, wheat starch and zinc chloride.

Suitable GRAS materials that are suitable for use in the invention, identified as originating from either paper or paperboard stock materials used as substrates in the invention, include alum (double sulfate of aluminum and ammonium potassium, or sodium), aluminum hydroxide, aluminum oleate, aluminum palmitate, casein, cellulose acetate, cornstarch, diatomaceous earth filler, ethyl cellulose, ethyl vanillin, glycerin, oleic acid, potassium sorbate, silicon dioxides, sodium aluminate, sodium chloride, sodium hexametaphosphate, sodium hydrosulfite, sodium phospho-aluminate, sodium silicate, sodium sorbate, sodium tripolyphosphate, sorbitol, soy protein (isolated), starch (acid modified, pregelatinized and unmodified), talc, vanillin, zinc hydrosulfite and zinc sulfate.

Water

When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

Cleaning Substrate

The cleaning composition may be part of a cleaning substrate. A wide variety of materials can be used as the cleaning substrate. The substrate should have sufficient wet strength, abrasivity, loft and porosity. Examples of suitable substrates include, nonwoven substrates, wovens substrates, hydroentangled substrates, foams and sponges and similar materials which can be used alone or attached to a cleaning implement, such as a floor mop, handle, or a hand held cleaning tool, such as a toilet cleaning device. The terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes.

EXAMPLES

The compositions are simple, natural, high performance cleaning formulations with a minimum of essential natural ingredients. Competitive cleaners are either natural and inferior in performance or contain additional ingredients that make them non-natural, such as synthetic components. Because preservatives, dyes and colorants are used in such small amounts, these may be synthetic and the entire composition may still be characterized as natural. Preferably, the compositions contain only natural preservatives, dyes, and colorants, if any.

Table I illustrates all purpose cleaners of the invention. Table II illustrates glass cleaners of the invention. Table III illustrates additional cleaning compositions of the invention. Table IV illustrates additional cleaning compositions of the invention. Table V illustrates sample cleaning compositions on a hard surface (i.e. glass).

TABLE I

| All Purpose Cleaner | A | B | C | D | E | F |
|---|---|---|---|---|---|---|
| Glucopon ® 425N[1] | 2.24 | 3.00 | 1.00 | 5.00 | 1.50 | 3.00 |
| Ethanol | 1.16 | 3.00 | 0.50 | 5.00 | 1.50 | 1.50 |
| Glycerol | 0.22 | 0.30 | 0.10 | 1.00 | 0.50 | 0.30 |
| Lemon oil | 0.22 | 0.30 | 0.10 | 0.40 | | 0.20 |
| Essential oil w D-Limonene Essential Oil | | | | | 0.25 | |
| Preservative and Dye | 0.005 | None | 0.002 | 0.001 | 0.01 | 0.005 |
| Sodium Carbonate | | | | 0.15 | 0.10 | |
| Water | balance | balance | balance | balance | balance | balance |

[1]Coco glucoside from Cognis.

TABLE II

| Glass Cleaner | G | H | I | J | K | L |
|---|---|---|---|---|---|---|
| Glucopon ® 425N | 0.60 | 1.50 | 0.30 | 0.50 | 0.50 | 1.00 |
| Ethanol | 2.00 | 3.00 | 1.50 | 0.50 | 1.00 | 2.00 |
| Glycerol | 0.11 | 0.20 | 0.05 | 0.05 | 0.10 | 0.20 |
| Lemon oil | | 0.20 | 0.05 | 0.05 | | |
| Essential oil w D-Limonene | 0.05 | | | | 0.10 | 0.15 |
| Preservative and Dye | 0.005 | 0.005 | 0.005 | 0.005 | 0.005 | 0.005 |
| Sodium Carbonate | 0.07 | 0.20 | 0.05 | 0.15 | | 0.15 |
| Water | balance | balance | balance | balance | balance | balance |

TABLE III

| All Purpose Cleaner | M | N | O | P |
|---|---|---|---|---|
| Glucopon ® 215[1] | 2.00 | | | 2.00 |
| Glucopon ® 252[2] | | 1.50 | | |
| Glucopon ® 325[3] | | | 0.50 | |
| Glucopon ® 600[4] | | | | |
| Ethanol | 1.00 | 1.00 | 1.00 | 2.00 |
| Glycerol | 0.20 | 0.20 | 0.10 | 0.15 |
| Lemon oil | | | 0.10 | 0.20 |
| D-Limonene | | 0.15 | | |
| Essential oil with d-limonene | 0.20 | | | |
| Preservative and Dye/Colorant | 0.005 | 0.005 | 0.005 | 0.005 |

TABLE III-continued

| All Purpose Cleaner | M | N | O | P |
|---|---|---|---|---|
| Sodium Bicarbonate | 0.50 | | | |
| Sodium Hydroxide | | 0.05 | | 0.05 |
| Sodium Silicate | | | 0.05 | 0.05 |
| Water | balance | balance | balance | balance |

[1]Capryl glucoside from Cognis.
[2]Decyl glucoside from Cognis.
[3]C9-C11 glucoside from Cognis.
[4]Lauryl glucoside from Cognis.

TABLE IV

| Cleaner | Q | R | S | T | U | V |
|---|---|---|---|---|---|---|
| Glucopon ® 425N[1] | 3.00 | 3.00 | 3.00 | 3.00 | 2.75 | 3.25 |
| Ethanol | 3.00 | 3.00 | 2.00 | 2.00 | 3.00 | 2.50 |
| Glycerol | | 0.20 | 0.20 | 0.11 | | |
| Lemon oil | 0.30 | | | | | |
| Essential oil w D-Limonene | | | 0.20 | | | |
| Essential Oil | | 0.25 | | | | |
| Preservative and Dye | 0.01 | 0.02 | 0.01 | 0.01 | 0.02 | |
| Sodium Carbonate | | | | | 0.1 | |
| Water | balance | balance | balance | balance | balance | balance |

TABLE V

| Cleaner | W | X | Y | Z | AA | BB |
|---|---|---|---|---|---|---|
| Glucopon ® 425N (Cognis Corp.) (C8-C16 APG) | 0.60 | 0.30 | 0.90 | 0.40 | 0.10 | 0.05 |
| Glucopon 215N (Cognis Corp.)(C8-C10 APG) | 0.60 | 0.90 | 0.30 | 0.55 | 0.05 | 0.50 |
| Ethanol | 2.80 | 3.30 | 0.00 | 2.00 | 0.00 | 3.60 |
| Isopropanol | 0.10 | 0.20 | 0.20 | 0.10 | 0.20 | 0.20 |
| 1,3-Propanediol | 0.00 | 0.00 | 0.00 | 0.00 | 3.50 | 0.00 |
| Sorbitol | 0.00 | 0.00 | 2.50 | 0.00 | 0.00 | 0.00 |
| Acetic Acid | 0.25 | 0.50 | 0.75 | 0.10 | 0.35 | 0.50 |
| Glycerol | 0.00 | 0.10 | 0.00 | 0.00 | 0.20 | 0.00 |
| Anti-foaming Agent | 0.00 | 0.00 | 0.10 | 0.00 | 0.10 | 0.00 |
| Fragrance | 0.00 | 0.00 | 0.00 | 0.025 | 0.05 | 0.025 |
| Water | balance | balance | balance | balance | balance | balance |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

I claim:

1. A hard surface liquid, cleaning composition consisting essentially of:

a. 0.01 to 5.0 weight % alkyl polyglucoside;

b. 0.5 to 5.0 weight % of sorbitol;

c. 0.05 to 3.0 weight % of acetic acid;

d. water; and e. optionally dyes, builders, fatty acids, polymers, fragrances, colorants, anti-foaming agent and preservatives.

2. The composition of claim 1, wherein the alkyl polyglucoside is a mixture of $C_8$ to $C_{10}$ alkyl polyglucoside and $C_8$ to $C_{16}$ alkyl polyglucoside.

3. The composition of claim 1, wherein the composition contains a solvent selected from the group consisting of ethanol, isopropanol, glycerol, propylene glycol, 1,3-propanediol and mixtures thereof.

4. The composition of claim 1, wherein the pH is less than 7.

5. The composition of claim 1, wherein the pH is less than 5.

6. The composition of claim 1, wherein the composition contains 0.01-3.0 weight % alkyl polyglucoside.

7. The composition of claim 1, wherein the composition contains 0.01-1.0 weight % alkyl polyglucoside.

8. The composition of claim 1, wherein the sorbitol is between 0.5 to 4.0 weight %.

9. The composition of claim 1, wherein the hard surface is glass.

10. A hard surface liquid, cleaning composition consisting essentially of:

a. 0.01 to 5.00% alkyl polyglucoside of a $C_8$ to $C_{10}$ alkylpolyglucoside wherein the alkyl group is substantially $C_8$ alkyl, substantially $C_{10}$ alkyl, or a mixture of substantially $C_8$ and $C_{10}$ alkyl;

b. 0.01 to 5.0% alkyl polyglucoside of a $C_8$ to $C_{16}$ alkylpolyglucoside;

c. 0.5 to 5.0 weight % of sorbitol;

d. 0.05 to 3.0 weight % of acetic acid;

e. water; and f. optionally dyes, glycerol, builders, fatty acids, polymers, fragrances, colorants, anti-foaming agents and preservatives.

11. The composition of claim 10, wherein the pH is less than 7.

12. The composition of claim 10, wherein the pH is less than 5.

13. The composition of claim 10, wherein the composition contains a total of 0.01-3.0 weight % alkyl polyglucoside.

14. The composition of claim 10, wherein the composition contains a total of 0.01-1.0 weight % alkyl polyglucoside.

15. The composition of claim 10, wherein the sorbitol is between 0.5 to 4.0 weight %.

16. The composition of claim 10, wherein the hard surface is glass.

17. A hard surface liquid, cleaning composition comprising:

a. 0.01 to 5.0 weight % alkyl polyglucoside;

b. 0.5 to 5.0 weight % of sorbitol;

c. 0.05 to 3.0 weight % of acetic acid;

d. water; and e. optionally dyes, builders, fatty acids, polymers, fragrances, colorants, anti-foaming agent and preservatives, wherein said composition contains no additional surfactant and no additional solvent.

18. The composition of claim 17, wherein the pH is less than 7.

19. The composition of claim 17, wherein the pH is less than 6.

20. The composition of claim 17, wherein the pH is less than 5.

* * * * *